US007427060B2

(12) United States Patent
Taniyama

(10) Patent No.: US 7,427,060 B2
(45) Date of Patent: Sep. 23, 2008

(54) SHEET CONVEYING DEVICE, IMAGE FORMING APPARATUS AND METHOD FOR CONVEYING SHEET

(75) Inventor: Yoshiharu Taniyama, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 162 days.

(21) Appl. No.: 11/189,821

(22) Filed: Jul. 27, 2005

(65) Prior Publication Data

US 2005/0258587 A1 Nov. 24, 2005

Related U.S. Application Data

(63) Continuation of application No. 10/370,736, filed on Feb. 24, 2003, now Pat. No. 6,932,337.

(51) Int. Cl.
*B65H 3/52* (2006.01)

(52) U.S. Cl. ..... 271/122; 271/125; 271/274

(58) Field of Classification Search ..... 271/122, 271/124, 125, 274
See application file for complete search history.

(56) References Cited

U.S. PATENT DOCUMENTS 4,083,555 A 4/1978 Irvine et al.
4,613,127 A 9/1986 Wishart et al.
5,207,788 A * 5/1993 Geib et al. ..... 271/122
5,350,168 A 9/1994 Sheridan
6,000,689 A * 12/1999 Furuki et al. ..... 271/10.11
6,672,579 B2 1/2004 Araki et al.

FOREIGN PATENT DOCUMENTS

JP 63-171737 * 7/1988
JP 2-209275 A 8/1990
JP 3-182445 A 8/1991
JP 2000-302279 * 10/2000

* cited by examiner

*Primary Examiner*—Patrick Mackey
*Assistant Examiner*—Thomas A Morrison
(74) *Attorney, Agent, or Firm*—Foley & Lardner LLP

(57) ABSTRACT

The sheet paper conveying device comprises: paper supply rollers at least part of which rotate to convey the sheet paper in a prescribed direction; separation rollers that rotate in the direction reverse to the sheet paper conveying direction or rotates jointly with the paper supply roller; auxiliary rollers that clamp the sheet paper jointly with the paper supply rollers and freely rotate; a first pressurizing member to press the separation rollers against the paper supply roller side; and a second pressurizing member to press the auxiliary roller against the paper supply roller side.

5 Claims, 3 Drawing Sheets

SHEET CONVEYING DEVICE, IMAGE FORMING APPARATUS AND METHOD FOR CONVEYING SHEET

The present application is a Continuation of U.S. application Ser. No. 10/370,736, filed Feb. 24, 2003 now U.S. Pat. No. 6,932,337, the entire contents of which are incorporated herein by reference.

BACKGROUND OF THE INVENTION

1. Field of the Invention

The present invention relates to a sheet paper conveying device, an image forming apparatus and a sheet paper conveying method to convey sheet paper in prescribed direction while separating paper one by one.

2. Description of the Related Art

As a device to convey sheet paper in the direction of an image forming apparatus in such image forming apparatus as printers, copying machines or facsimiles, a paper feeding mechanism comprising feed rollers and opposite rollers that are split separately is so far disclosed in Japanese Patent Publication No. 2002-209275. Also, a paper conveying mechanism of which pressure rollers opposing to conveying rollers are divided into plural units each of which is pressed against the conveying rollers is disclosed in Japanese Patent Application No. 2003-182445. However, either of the above-mentioned conventional paper conveying mechanisms have not a function to separate more than 2 sheets of overlapped paper one by one.

On the other hand, there is a sheet paper conveying device provided with paper supply rollers and opposing separation rollers. In this device, while the paper supply rollers are rotated in the paper conveying direction, the separation rollers are rotated in the direction reverse to the sheet conveying direction and only one sheet of paper kept in contact with the paper supply roller is separated and conveyed. In this conventional apparatus that has a separation and conveying function, a pressing load of the separation rollers (hereinafter, referred to as pushing pressure W) against the paper supply roller and a separation torque T of the separation rollers are concerned as factors to determine a set value for separating paper and a separation torque T of the separation roller. This pushing pressure W and the separation torque T are in such a relation that when the separation torque T is kept constant, the separation margin increases and the paper supply margin decreases and the conveyance becomes defective when the pushing pressure W is made small. On the other hand, when the separation torque T is kept constant and the pushing pressure W is increased, the paper supply margin increases, the separation margin decreases and the defective separation is caused.

Because of this antithetical relation of the separation margin and the paper supply margin, to determine the separation torque T and the pushing pressure W of a paper conveying device that has the separation function, it was necessary to measure the separation margin or the paper supply margin by a paper conveying device in an image forming apparatus and set the separation torque T and the pushing pressure W in an area wherein both the separation margin and the paper supply margin can be secured. In other words, when separation torque T, pushing pressure W, coefficient of friction of the paper supply roller $\mu rp$ and coefficient of margin between paper are $\mu rp > T/W > \mu pp$, both the separation margin and the paper supply margin can be secured (the coefficient of friction referred to here is y/x when a weight of paper that can be conveyed at a fixed load x is y). For example, the separation margin and paper supply margin were so far decided while balancing T/W, by assuming a coefficient of friction of paper supply rollers at 1.3 (130 g paper can be conveyed at 100 g load) and a coefficient of friction between paper at 0.6 (60 g paper can be conveyed at 100 g load).

However, with the diversification of paper and popularization of reclaimed paper, the conveyance of paper having a higher value of coefficient of friction between paper $\mu pp$ is demanded in recent years. Therefore, the balance adjustment of the separation torque T and the pushing pressure W is difficult and depending on kind of paper, paper cannot be separated or supplied in some cases. Further, when tried to increase a separation margin or paper supply margin for achieving separation and conveyance of various kinds of paper, the service life of the paper supply rollers and separation rollers can be shortened and practical use of them may be impeded.

Accordingly, in the sheet paper conveying device, it is demanded to expand kinds of paper for separation conveyance and to keep the long service life of the paper supply rollers and the separation rollers.

SUMMARY OF THE INVENTION

An object of the present invention is to expand kinds of paper that can be supplied corresponding to diversified paper and obtain long life paper supply rollers and separation rollers.

According to a preferred embodiment of the present invention, there is provided a sheet paper conveying device comprising: paper supply rollers at least a part of which rotates to convey the sheet paper in a prescribed direction; separation rollers that clamp the sheet paper jointly with the paper supply rollers and are driven to rotate in the direction reverse to the paper conveying direction or rotate following the rotation of the paper supply rollers; auxiliary rollers that rotate freely with the sheet paper clamped jointly with the paper supply rollers; a first pressing member to press the separation rollers to the paper supply roller side; and a second pressing member to press the auxiliary roller to the paper supply roller side.

Further, according to the present invention, there is provided an image forming apparatus comprising: a sheet paper supporting members provided to the main body of the apparatus to support sheet paper; paper supply rollers kept in contact with the sheet paper taken out of the sheet paper support member and at least a part of which rotates to convey the sheet paper in a prescribed direction; separation rollers that clamp the sheet paper jointly with the paper supply rollers and driven to rotate in the direction reverse to the conveying direction of the sheet paper or rotate following the paper supply roller; auxiliary roller to clamp the sheet paper jointly with the paper supply rollers and rotate freely; a first pressing member to press the separation rollers to the paper supply roller side; a second pressing member to press the auxiliary roller to the paper supply roller; and an image forming means provided in the main body of the apparatus and forms an image on the sheet paper conveyed in the prescribed direction by the paper supply roller.

Further, according to the embodiment of the present invention, in a sheet paper conveying method to clamp the sheet paper by the paper supply rollers rotating to convey sheet paper in a prescribed direction and the separation roller that is driven to rotate in the direction reverse to the sheet paper conveying direction or rotate following the rotation of the paper supply rollers to further clamp the sheet paper by the freely rotating auxiliary roller and the paper supply roller and press the separation roller and the auxiliary roller against the paper supply rollers.

DETAILED DESCRIPTION OF THE EMBODIMENTS

Figure 1:
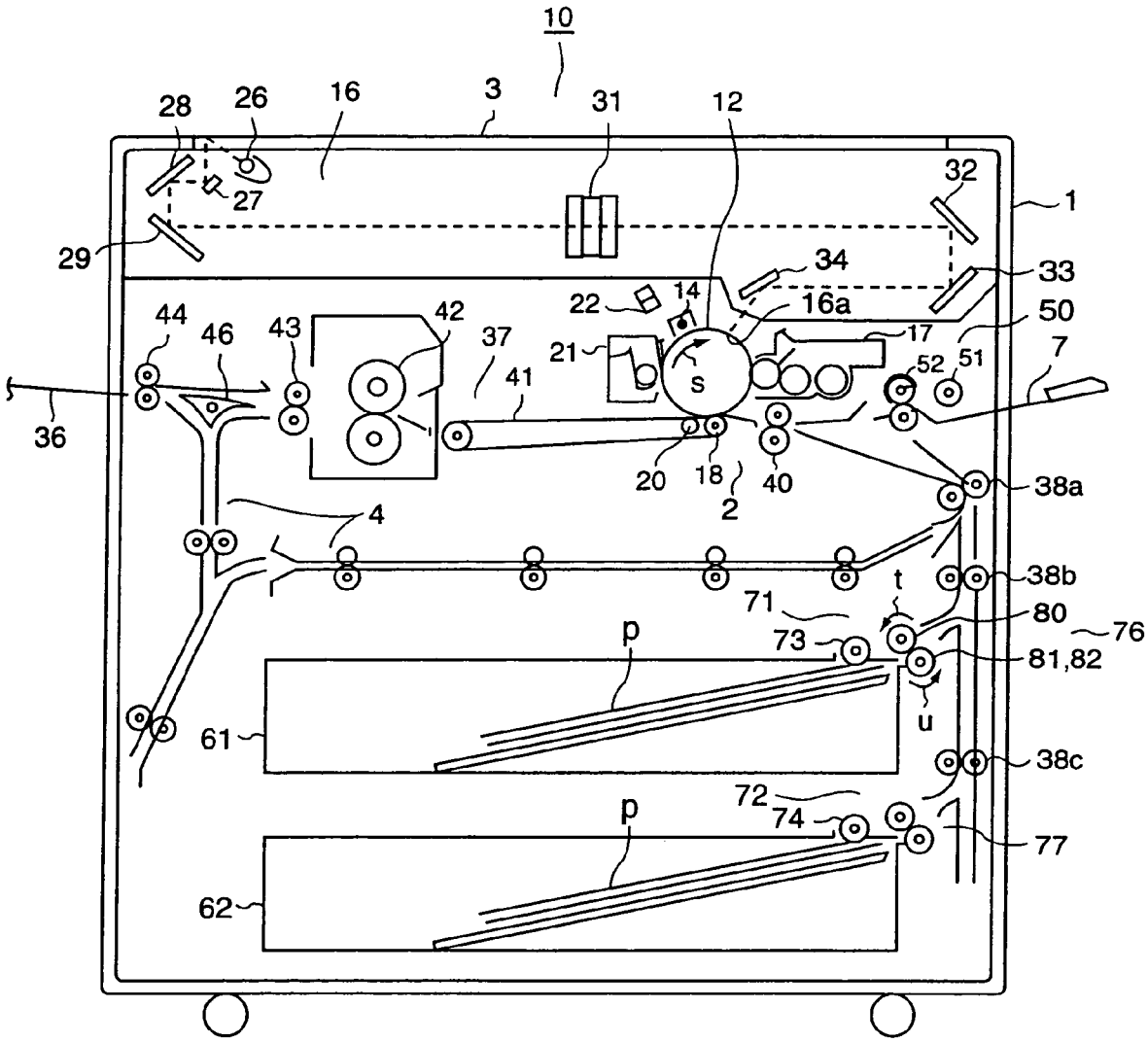
FIG. 1 is a schematic diagram showing an image forming apparatus in the first embodiment of the present invention.
Figure 2:
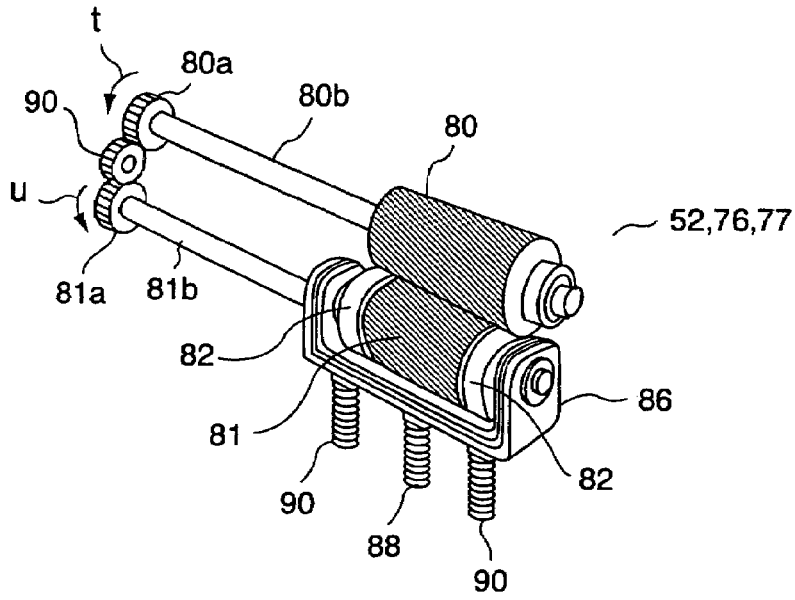
FIG. 2 is a schematic perspective view showing the sheet paper conveying device in the first embodiment of the present invention
Figure 3:
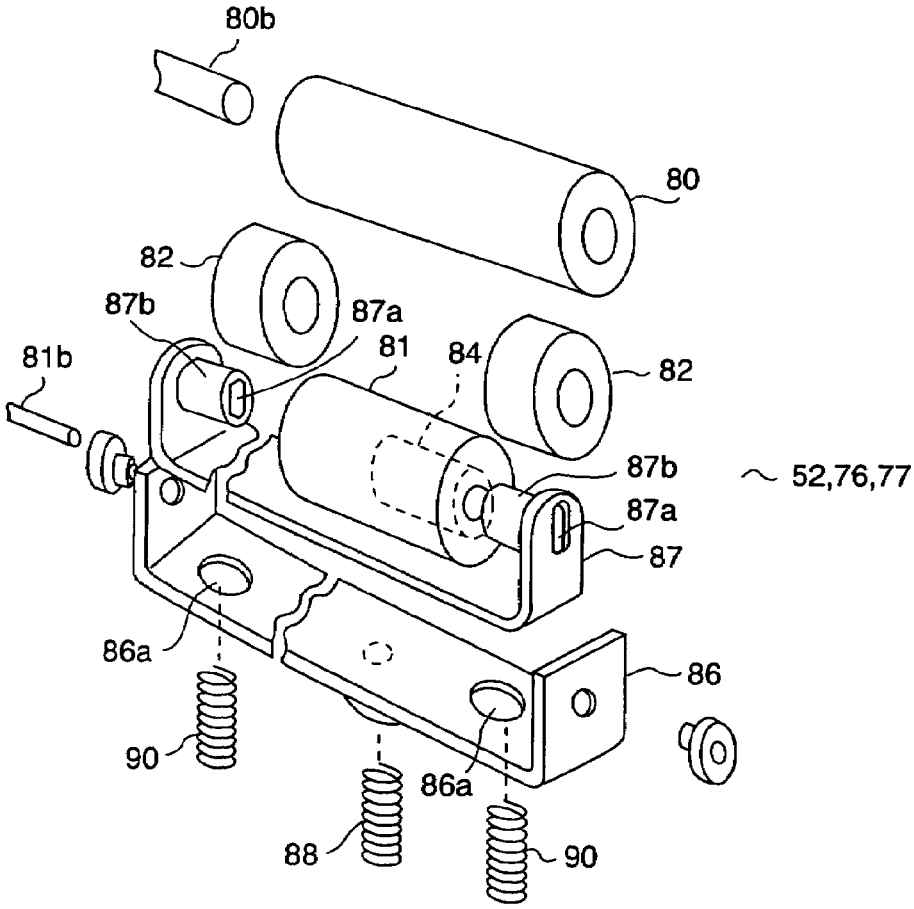
FIG. 3 is an exploded perspective view partially showing the separation rollers in the first embodiment of the present invention.

Preferred embodiments of the present invention will be described below in detail referring to the attached drawings. FIG. 1 is a schematic diagram showing the entire structure of an image forming apparatus 10 in a first embodiment of the present invention. In the main body of the image forming apparatus, there are a manual paper supply mechanism 50 to separate and convey sheet paper P in the direction of an image forming means 2 that is a prescribed direction from a manual paper feed tray 7 and first and second cassette paper feed mechanisms 71, 72 which separate and convey sheet paper P from the first and second paper feed cassette devices 61, 612 in the direction of the image forming means 2. On the top surface of the main body 1, there is a document table 3 on which documents are placed.

Above the paper feed cassette devices 61, 62, there is provided a reverse conveying path 4 for reversing sheet paper P passed through the image forming means 2 and a fixing roller 2 for copying both sides of sheet paper.

Further, the image forming means 2 is composed of a main charger 14, an exposing portion 16*a* of an exposing unit 16, a developing unit 17, a transferring roller 18, a separation roller 20, a cleaner 21 and a charge elimination lamp 22 arranged around a photosensitive drum 12 that is turned in the arrow direction s. The exposing unit 16 applies the light from an exposing lamp 26 to a document placed on the document table 3 on the top surface of the main body 1, leads the reflecting light from the document to a lens 31 by first through third mirrors 27~29 and further, leads the reflecting light passed through the lens 31 to the photosensitive drum 12 by way of fourth~sixth mirrors 32~34. Further, in the main body 1, there are a reverse conveying path 4, paper cassettes 51, 62 and a sheet paper conveying path 37 to lead sheet paper P conveyed from the manual supply tray 7 to a paper discharging tray 36 provided at the left side of the main body 1 via the photosensitive drum 12.

At the upper stream side from the photosensitive drum 12 of the sheet paper conveying path 37, first to third conveying rollers 38*a*, 38*b*, 38*c* and an aligning roller 40 are arranged. At the downstream side from the photosensitive drum 12 of the sheet paper conveying path 37, a conveyor belt 41, a fixing roller 42 and a transmission roller 43 are arranged and further, a gate 46 is provided to distribute sheet paper P either to the paper discharging roller 44 side or the reverse conveying path 4 side.

The manual paper supply mechanism 50 has a manual pickup roller 51 and a manual sheet paper separation/conveying roller 52. First and second cassette paper supply mechanisms 71, 72 have first and second pickup rollers 73, 74 and first and second sheet paper separation/conveying rollers 76, 77, respectively.

Next, the manual sheet paper separation/conveying roller 52 and the first and second sheet paper separation/conveying rollers 76, 77 will be explained in detail. Further, as the sheet paper separation/conveying roller 52 and the first and second sheet paper separation/conveying rollers 76, 77 are in the same structure, they will be explained by taking one of them as an example. For example, the first sheet paper separation/conveying roller 76 has a paper supply roller 80 and a separation roller 81 opposing to the paper supply roller 80 for clamping sheet paper P and further has an auxiliary roller 82 opposing to the paper supply roller 80 to clamp sheet paper P.

The paper supply roller 80 is in an outer diameter 24 mm and a length 40 mm, made of a synthetic resin having a high coefficient of friction, etc. This roller 80 is driven by a motor (not shown) to rotate in the arrow direction t and conveys sheet paper P in the direction of the photosensitive drum 12. The separation roller 81 is in an outer diameter 24 mm and a length 20 mm, made of a synthetic rubber having a high coefficient of friction, etc. and is driven by a motor (not shown) via a separation gear 81*a* and a separation shaft 81*b* that are driven by a link gear 83 and rotate in the same direction as the paper supply gear 80*a* in the arrow direction u and separate sheet paper P in the direction of the first paper supply cassette 61. Further, the separation roller 81 is attached to the separation shaft 81*b* via a torque limiter 84. Thus, when a torque applied to the separation roller 81 by the opposing paper supply roller 80 exceeds a fixed limit, the rotation of the separation roller 81 is changed over from the driving by the separation shaft 81*b* to the drive with the paper supply roller 80 or the drive with sheet paper.

The separation shaft 81*b* is supported by a separation rack 86 that has a penetrating port 86*a* at the bottom. At both sides of the separation roller 81, there is provided an auxiliary roller 82 in an outer diameter 24 mm and a width 10 mm that is made of such a resin as POM (polyacetal) that is able to limit a coefficient of friction with sheet paper P to below 0.5 and freely rotates. At both ends of the auxiliary rack 87 supporting the auxiliary roller 82, a slit 87*a* into which the separation shaft 81*b* is inserted is formed. In the inside of the auxiliary rack 87, a holder 87*b* made of POM, etc. is fixed to support the auxiliary roller 81 in the freely rotatable state. A slit 87*a* is penetrated through the holder 87*b*. Thus, the auxiliary roller 82 supported by the auxiliary rack 87 becomes movable in the direction vertical to the separation shaft 81*b*.

The separation rack 86 is given a fixed pressing force at an almost central portion by a first pressurizing spring 88 that is a first pressing member. The auxiliary rack 87 is given a fixed pressing force at both sides by a second pressurizing spring 90 that is a second pressing member.

In the first sheet paper separation/conveying rollers 76 in this structure, when the pressure W of the separation roller 81 by the first pressurizing spring 88 is assumed as constant, the conveying force of sheet paper P can be increased by increasing the pushing pressure W1 and W2 by the second pressurizing spring 90. Furthermore, as the coefficient of friction of the auxiliary roller 82 is below 0.5, when 2 sheets of sheet paper P are inserted in the overlapped state between the paper supply roller 80 and the separation roller 81, the sheet paper conveying force at the separation roller 81, there is no possibility for increasing the conveying force of sheet paper at the separation roller 81 side more than needed and no adverse effect is produced to the separation efficiency.

Further, the auxiliary roller 82 is not rotated by a driving source but is provided as a driven roller that is freely rotatable and therefore, when more than 2 sheets are overlapped, the friction resistance of the auxiliary roller 82 is lower than the friction resistance between sheets and it is possible to suppress the conveying force to sheet paper at the separation roller 81 low. In other words, the auxiliary roller 82 has a function to assist the conveyance of sheet paper P by the paper supply roller 80 without affecting the separation efficiency of the separation roller 81. Further, the pushing pressure W1, W2 of the auxiliary roller 82 by the second spring 90 is adjustable separately for the left and right sides when necessary.

When manufacturing such the first sheet paper separation/conveying roller 76, the pushing pressure W of the separation roller 81 is decided by adjusting the first pressure spring 88 by considering the separation margin only. Thereafter, by considering the paper supply margin only, the pushing pressures W1, W2 of the auxiliary roller 82 are decided by adjusting the second pressurizing spring 90 and the conveying force of the auxiliary roller 82 is added to the paper supply efficiency by the paper supply roller 80. Thus, it becomes not necessary to adjust the pushing pressure W and the separation torque T of the separation roller 81 while balancing them in order to obtain a desired paper supply margin and the separation margin as before.

Accordingly, for example, when the separation torque of the separation roller is especially increased in order to execute the separation conveyance of sheet paper P having a large coefficient of friction between paper by the first sheet paper separation/conveying roller 76, additional conveying force is further added to the paper supply efficiency of the paper supply roller 80 by increasing the pushing pressures W1, W2 of the auxiliary roller 82.

In such the first sheet paper separation/conveying roller 76, when there is no sheet paper P between the paper supply roller 80 and the separation roller 81, the separation roller 81 is rotated in the direction to convey sheet paper by the rotary torque of the paper supply roller 80 and the relative formula at this time becomes .mu.fr*W>T (here, .mu.fr is a coefficient of rotation between the paper supply roller 80 and the separation roller 81).

Further, in the first sheet paper separation/conveying roller 76, when only one sheet of sheet paper P is inserted between the paper supply roller is driven following the sheet paper P in the direction to convey sheet paper. The relative formula at this time is μfp*W>T (here, μrp is a coefficient of friction between the paper supply roller 80 and sheet paper) and μrp*W>T (here, μrp is a coefficient of friction between the separation roller 81 and sheet paper).

Further, in the first sheet paper separation/conveying roller 76, when more than 2 sheets of sheet paper P are inserted between the paper supply roller 80 and the separation roller 81, the separation roller 81 is kept rotating in the direction reverse to the sheet paper conveying direction. The relative formula at this time is μfp*W>μpp (here, μpp is a coefficient between sheet paper) and μpp*W >T.

That is, while the paper supply roller 80 rotates always in the direction to convey sheet paper, the separation roller 81 rotates in the direction to convey sheet paper or rotate in the direction reverse to the direction to convey sheet paper P depending on presence and the number of sheet paper.

Figure 4:
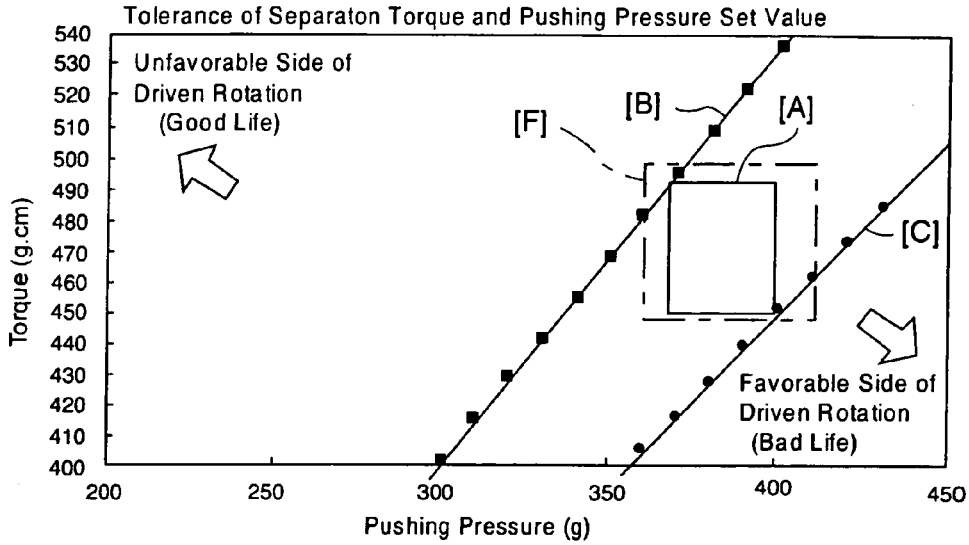
FIG. 4 is a graph showing the tolerance of set values of separation torque T and pushing pressure W in the first embodiment of the present invention.
Figure 5:
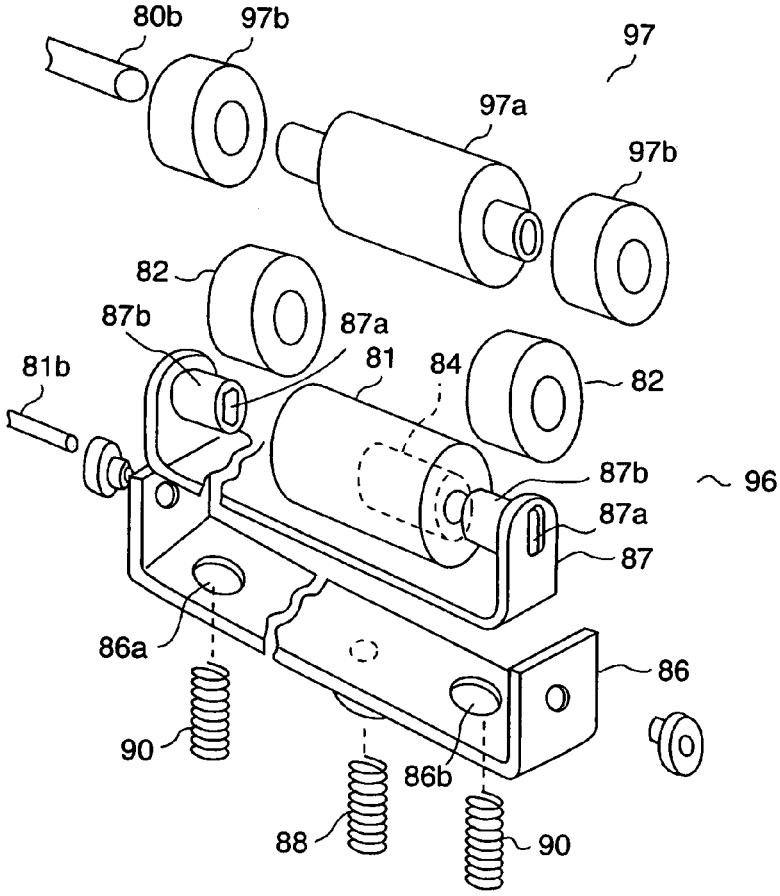
FIG. 5 is an exploded perspective view showing the sheet paper conveying device in the second embodiment of the present invention.

Then, limit tests of the condition setting ranges of pushing pressure W and separation torque T of the first sheet paper separation/conveying roller 76 having the auxiliary roller 82 and a conventional sheet paper separation/conveying roller (as a comparison example) comprising a pair of paper supply rollers and separation rollers was conducted with the results shown in FIG. 4. (However, both the paper supply rollers and separation rollers of the comparison example were in an outer diameter 24 mm and length 20 mm). First, in (Comparison Example), the range of setting conditions of pushing pressure W and separation torque T was the range enclosed by the solid line [A].

In this test, the disadvantageous limit of driven rotation causing defective paper supply was detected by varying pushing pressure W and separation torque T of the separation roller 81 while balancing them and the straight line [B] was obtained. In the area above this straight line [B], the life of the paper supply rollers is good but the defective paper supply is produced. Similarly, the limit for achieving life setting 200 k sheets was detected by varying pushing pressure W and separation torque T of the separation rollers while balancing them and the straight line [C] was obtained. The area below this straight line [C] is an advantageous side for driven rotation to supply paper certainly.

From the above-mentioned results, in (Comparison Example), when the range of pushing pressure W and separation torque T of the separation rollers is an area enclosed by the straight lines [B] and [C], satisfactory paper supply margin and separation margin are obtainable. However, when variation in manufacturing sheet paper separation/conveying rollers or variation in installing to an image forming apparatus is considered, the setting range of pushing pressure W and separation torque T from where satisfactory paper supply margin and separation margin are obtained is further limited.

Definitely, when separation torque T 470 g·cm and pushing pressure W 380 g are made as central setting values in order to give versatility of sheet paper separation/conveying rollers to expand kinds of sheet paper that can be supplied, the range enclosed by the solid line [A] becomes a range obtainable satisfactory paper supply and separation. Accordingly, it was so far necessitated to manufacture sheet paper separation/conveying rollers so that the balance of pushing pressure W and separation torque T of separation rollers fall in the range enclosed by the solid line [A].

On the other hand, in the first sheet paper separation/conveying roller 76 in this embodiment, the range of pushing pressure W and separation torque setting condition was the range enclosed by the one-dot chain line [F] shown in FIG. 4. In the first sheet paper separation/conveying roller 76, the pushing pressure W of the separation roller 81 by the first pressurizing spring 88 was set lower by 10 g than that in (Comparison Example) in order to improve the life of the paper supply roller 80. Further, in order to cover the paper supply efficiency of the paper supply roller 80 dropped by reducing the pushing pressure W, a conveying force was added by applying pushing pressure W1, W2 to the auxiliary roller 82 by the second pressurizing spring 90.

As a result, in the limit area of disadvantageous side of driven rotation and the limit area wherein the life setting 200 k was achievable, the setting ranges of pushing pressure W and separation torque T of the separation roller 81 could be expanded when compared with those in (Comparison Example). Definitely, when the separation torque T 470 g.cm and the pushing pressure W 380 g were made at the central set values, a range enclosed by the one-dot chain line [F] becomes a range wherein satisfactory paper supply and separation are obtainable.

Accordingly, as the setting range of pushing pressure W and separation torque T of the separation roller 81 becomes larger than that in (Comparison Example), the manufacturing yield of the first sheet paper separation/conveying roller 76 increases and mass production efficiency is improved. Further, the same applies to the manual supply sheet paper separation/conveying roller 52 and the second sheet paper separation/conveying roller 77. Thus, the manual supply sheet paper separation/conveying roller 52 and the first and second sheet paper separation/conveying rollers 76, 77 with W1, W2 of the pushing pressure W of the separation roller 81 and the auxiliary roller 82 by the first and second pressurizing springs 88, 90 adjusted are installed in the image forming apparatus 10.

When the image forming process starts in the image forming apparatus 10, following the rotation of the photosensitive drum 12 in the arrow direction s, the charging, exposing and developing processes are executed in order and a toner image is formed on the photosensitive drum 12.

On the other hand, at the manual paper feed tray 7 and the paper supply sides of the first and second paper supply cassettes 61, 62, prescribed sheet paper P is taken out by the pickup rollers s 51, 73, 74. Then, depending on whether the taken out sheet paper P is one or plural sheets, the sheet paper P is separated and conveyed in the direction of the aligning roller 40 by one sheet at a time by the actions of the paper supply roller 80, separation roller 81 and auxiliary roller 82 by each sheet paper separation/conveying roller 52, 76, 77. Further, in the both side copying mode, sheet paper P is conveyed in the direction of the aligning roller 40 from the reverse conveying path 4.

Sheet paper P is aligned its leading edge by the aligning roller 40 and conveyed to the position of the transferring charger 18 in synchronous with a toner image on the photosensitive drum 12. A toner image on the photosensitive drum 12 is transferred on a sheet paper P at the position of the transferring charger 18. The sheet paper P is separated from the photosensitive drum 12 by the separation charger 20 and conveyed to the fixing roller 42 by the conveyor belt 41 and the toner image is heated, pressurized and fixed. After the toner image is fixed, the sheet paper P is conveyed in the direction of the paper discharge roller 44 or the reverse conveying path 4. Further, after completing the transfer, the photosensitive drum 12 is processed by the cleaner 21 and the charge elimination lamp 22 with its rotation and becomes ready for the next copying.

Further, when the separation and conveying tests of sheet paper P taken out from the manual paper supply tray 7, the first and second paper supply cassettes 61, 62 were conducted using the manual supply sheet paper separation/conveying roller 52 and the first and second sheet paper separation/conveying rollers 76, 77, a satisfactory separation and conveying was obtained even on hammer mill paper, etc. that are sheet paper having a high paper friction coefficient μpp and even after a successive separation and conveying of 2000 k sheets, the paper supply roller 80 maintained a satisfactory paper supply efficiency and a desired life was obtained.

According to this first embodiment, a sheet paper conveying power is further added to the paper supply efficiency by the paper supply roller 80 by providing a freely rotatable auxiliary roller 82 and clamping and conveying sheet paper jointly with the paper supply roller 80. Therefore, a sufficient paper supply margin is obtained regardless of setting a sufficient separation margin by the separation roller 81 and it becomes possible to separate and convey sheet paper having a high coefficient of friction between paper and expand kinds of sheet paper that can be separated and conveyed. Furthermore, abrasion by load applied to the paper supply roller 80 and the separation roller 81 is reduced by using the auxiliary roller 82 and the life of the paper supply roller 80 and the separation roller 81 can be extended.

In addition, as the tolerance of set values of the separation torque T and the pushing pressure W of the separation roller 81 is expanded more than before at the time of manufacturing the manual supply sheet paper separation/conveying roller 52 and the first and second sheet paper separation/conveying rollers 76, 77, the yield when mass producing the sheet paper separation/conveying rollers 52, 76, 77 can be improved and manufacturing cost can be reduced.

Next, a second embodiment of the present invention will be explained. This second embodiment differs from the first embodiment in the structure of paper supply rollers. Therefore, in this second embodiment, the same portions of the structure explained in the first embodiment are assigned with the same reference numerals and the detailed explanation thereof will be omitted. The paper supply roller 97 of the third sheet paper separation/conveying roller 96 is divided into a first paper supply roller 97*a* opposing to the separation roller 81 and a second paper supply roller 97*b* opposing to the auxiliary roller 82.

The first paper supply roller 97*a* is made of such resin as, for example, POM, etc. having a coefficient of friction with sheet paper P below 0.5 and freely rotates with a paper supply shaft 80*b*. The second paper supply roller 97*b* is made of a synthetic rubber, etc. having a high coefficient of friction. That is, in the third sheet paper separation/conveying roller 96, the auxiliary roller 82 opposing to the second paper supply roller 97*b* rotates freely and the first paper supply roller 97*a* opposing to the separation roller 81 rotates freely.

Therefore, while the paper supply margin and the separation margin were so far reduced, respectively by clamping sheet paper P with a paper supply roller and a separation roller having a high coefficient of friction, in the third sheet paper separation/conveying roller 96, the pushing pressure W of the separation roller 81 is concerned only in the separation efficiency and the pushing pressures W1, W2 of the auxiliary roller 82 are concerned only in the conveying power. That is, in the third sheet paper separation/conveying roller 96, the pushing pressure W does not affect the paper supply margin and the pushing pressures W1, W2 do not affect the separation margin. Further, when a coefficient of friction of the first paper supply roller 97*a* is low, it does not affect the separation efficiency of the separation roller 81 and therefore, the first paper supply roller 97*a* may not be free but can be interlocking with the second paper supply roller 97*b*.

At the time when this third sheet paper separation/conveying roller 96 is manufactured, the pushing pressure W of the separation roller 81 is decided by adjusting the first pressurizing spring 88 according to the separation torque T of the separation roller 81 that is set according to sheet paper P requiring the separation and conveyance. Thus, the separation roller 81 obtains a good separation margin. Thereafter, in order to obtain a good paper supply margin by the second paper supply roller 97*b*, the pushing pressures W1, W2 of the auxiliary roller 82 is decided by adjusting the second pressurizing spring 90. That is, adjustment of the first and the second pressurizing springs 88, 90 can be set only by considering the separation margin of the separation roller 81 or the paper supply margin of the second paper supply roller 97*b*.

In such the third sheet paper separation/conveying roller 96, when there is no sheet paper P between the paper supply roller 97 and the separation roller 81, the second paper supply roller 97*b* rotates in the direction to convey sheet paper and the separation roller 81 rotates in the direction reverse to the sheet paper conveying direction. When only one sheet of sheet paper P is inserted between the paper supply roller 97 and the separation roller 81, the separation roller 81 is driven to rotate in the sheet paper P conveying direction when the limit of the torque limiter 84 is exceeded by the conveyance of sheet paper P by the second paper supply roller 97*b*. Further, when more than 2 sheets of sheet paper P are inserted between the paper supply roller 97 and the separation roller 81, the separation roller 81 rotates in the direction reverse to the sheet paper conveying direction and performs the separating operation.

In other words, while the second paper supply roller 97*b* always rotates in the sheet paper P conveying direction, the separation roller 81 rotates in the sheet paper P conveying direction or in the reverse direction to the sheet paper P conveying direction depending on the number of sheets of sheet paper P and separates sheets.

According to the second embodiment, the first paper supply roller 97*a* opposing to the separation roller 81 is made free and the auxiliary roller 82 opposing to the second paper supply roller 97*b* is made free and thus, the paper supply margin and the separation margin do not affect each other. Therefore, the separation roller 81 is concerned with only the separation efficiency and the second paper supply roller 81 is concerned with only the paper supply efficiency and therefore, the manufacturing is easy only by adjusting them and desired separation margin and paper supply margin. Thus, it is possible to expand kinds of sheet paper that can be separated and conveyed.

Further, the present invention is not restricted to the above-mentioned embodiments but can be varied variously within the spirit and scope of this invention. For example, sizes, materials and the like of the rollers are optional and torque setting or pushing pressure of pressing members, etc. are also optional according to kinds of sheet paper requiring the separation and conveyance.

Further, in the first embodiment, the auxiliary roller 82 can be interlocked with the separation roller 81 without making it freely rotate. In this case, when sheet paper P is one sheet only, the torque limiter 84 reaches the limit faster and the separation roller 81 and the auxiliary roller 82 rotate in the conveying direction at a fast timing. On the other hand, when the number of sheet paper is more than 2 sheets, the auxiliary roller 82 rotates in the direction reverse to the conveying direction jointly with the separation roller 81 and it is possible to increase the separation efficiency.

As described above in detail, according to the present invention, the sheet paper conveying power can be added to the paper supply efficiency by the paper supply roller when an auxiliary roller to rotate freely as pressed to the paper supply roller. Accordingly, even when the separation margin of the separation roller is increased, the paper supply margin can be improved by adjusting the pushing pressure of the auxiliary roller is adjusted without applying load to the paper supply roller. That is, the separation/conveyance of versatile kinds of sheet paper becomes possible without impairing the life of the paper supply roller when the auxiliary roller is provided.

Further, the setting conditions of the separation roller to obtain the prescribed separation margin or the setting conditions of the auxiliary roller to obtain the paper supply margin are adjustable independently and the adjusting operation can be reduced. Furthermore, as the range of condition set values is expanded more than before, the yield in manufacturing the sheet paper separation/conveying mechanism can be improved and manufacturing cost can be further reduced.

What is claimed is:

1. A sheet paper conveying device, comprising:

a paper supply roller at least part of which is in contact with sheet paper and rotates to convey the sheet paper in a prescribed direction;

a separation roller which clamps the sheet paper jointly with the paper supply roller, is driven to rotate in the direction reverse to the sheet paper conveying direction or rotate following the rotation of the paper supply roller, the separation roller being attached to a shaft;

an auxiliary roller to clamp the sheet paper jointly with the paper supply roller and rotate freely; the auxiliary roller being provided on the shaft;

a first pressing member to press the separation roller to the paper supply roller side; and a second pressing member to press the auxiliary roller to the paper supply roller side, wherein pressure provided by the second pressing member to push the auxiliary roller to the paper supply roller side becomes relatively increased while the pressure provided by the first pressing member to push the separation roller to the paper supply roller side remains constant.

2. The sheet paper conveying device according claim 1, wherein the separation roller is equipped with a torque limiter and before the torque limiter is actuated, driven to rotate in the direction reverse to the sheet paper conveying direction and driven following the paper supply roller when the torque limiter is actuated.

3. The sheet paper conveying device according to claim 1, wherein the coefficient of friction of the auxiliary roller is below 0.5.

4. The sheet paper conveying device according to claim 1, wherein the paper supply roller is split into a first paper supply roller to clamp the sheet paper jointly with the separation roller and a second paper supply roller to clamp the sheet paper jointly with the auxiliary roller.

5. The sheet paper conveying device according to claim 4, wherein the coefficient of friction of the first paper supply roller is below 0.5 and the coefficient of friction of the auxiliary roller is below 0.5.

* * * * *